United States Patent [19]

Leisse

[11] 4,453,880

[45] Jun. 12, 1984

[54] CONTROL DEVICE FOR A LOADING DEVICE FOR BULK GOODS CONTAINERS

[75] Inventor: Norbert Leisse, Denkendorf, Fed. Rep. of Germany

[73] Assignee: Fahrzeugbau Haller GmbH, Stuttgart, Fed. Rep. of Germany

[21] Appl. No.: 266,357

[22] Filed: May 22, 1981

[51] Int. Cl.[3] ..... B65F 3/00

[52] U.S. Cl. ..... 414/525 R; 100/50

[58] Field of Search ..... 414/525 R; 100/48, 50

[56] References Cited

U.S. PATENT DOCUMENTS

| | | | |
|---|---|---|---|
| 3,534,678 | 10/1970 | Clar | 100/50 |
| 3,760,962 | 9/1973 | Clucker et al. | 414/525 R |
| 3,881,613 | 5/1975 | Torimoto et al. | 414/525 R |
| 3,938,679 | 2/1976 | Clucker et al. | 414/525 R |
| 3,999,669 | 12/1976 | Smith | 414/525 R X |
| 4,073,393 | 2/1978 | McKenzie et al. | 414/525 R |
| 4,155,297 | 5/1979 | Smith et al. | 414/525 R X |

*Primary Examiner*—Robert B. Reeves
*Assistant Examiner*—Edward M. Wacyra
*Attorney, Agent, or Firm*—Michael J. Striker

[57] ABSTRACT

A control arrangement for a loading device for bulk goods containers is proposed. The movement cycle of the loading device is controlled by an electronic control device. The control device has an input which is connected to several electric control signal transmitters which at a certain position of the loading device generate a signal. The output of the control device is connected to electric control members which switch on the drive of the loading device for different movement steps thereof. This is achieved by the control device through switching from one control member to another control member when the respective control signal transmitter generates a signal that the movement step of the loading device has occurred in a correct manner. In order to prevent any faulty controls, which occur when the control signal transmitters are not working properly, an arrest circuit is provided which prevents that the control signal transmitter transmits signals to the control device in an incorrect sequence. Consequently, undesired or even dangerous movement steps of the loading device are prevented.

18 Claims, 15 Drawing Figures

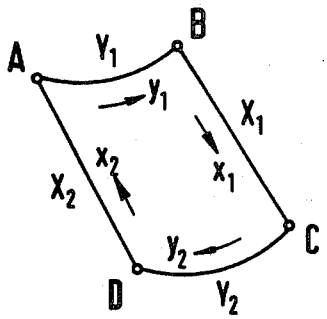
FIG. 9
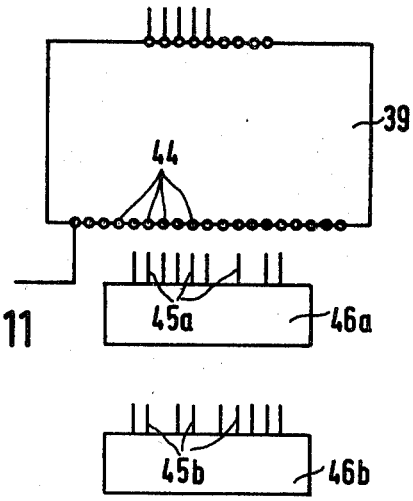
FIG. 11
FIG. 10
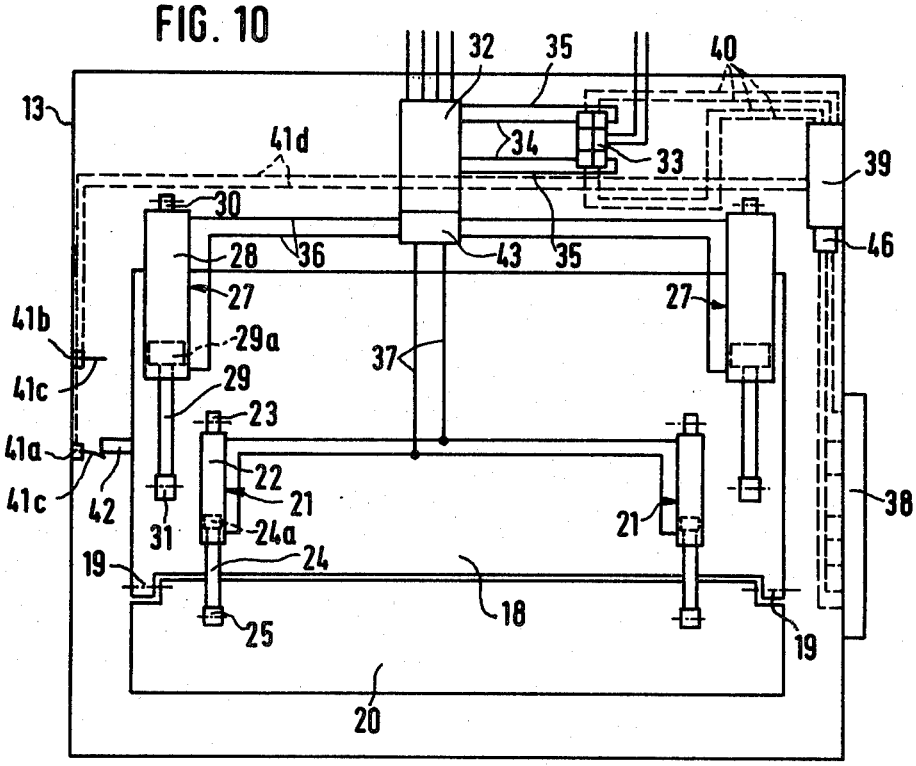

CONTROL DEVICE FOR A LOADING DEVICE FOR BULK GOODS CONTAINERS

BACKGROUND OF THE INVENTION

The invention relates to a control arrangement for a loading device for bulk goods containers, in particular trash vehicle containers with a chamber receiving the bulk goods and a motor-driven feeding shovel which executes a movement cycle, for feeding the bulk goods from the chamber into the bulk goods container. The movement cycle is divided into sequential movement phases which are initiated by control members actuated during the course of the movement cycle.

Such a control arrangement is known from the German Offenlegungsschrift DE-OS No. 18 04 088.

The loading device described in this reference contains a mechanically-hydraulically operated sequence circuit with which one movement phase of a shovel component of the loading device is initiated when the other shovel component has reached an end position.

Such a control, however, is rather cumbersome and cannot be arbitrarily mounted, since the control members must be placed at the controlled drive members. This is also disadvantageous in that the control members are mounted in areas which are subjected to dirt.

In furtherance, no measures are taken to eliminate faulty controls of the loading device in the state of the art.

SUMMARY OF THE INVENTION

It is an object of the invention to provide a simple constructed control which eliminates a faulty control of the feeding shovel due to false switching pulses which are not intended in the given movement phase and/or contradict with each other, so as to increase the safety against functional interferences and damages, in particular against endangering persons which are working on the loading device, or against damages on the feeding device.

A further object of the invention is to facilitate a false diagnosis during a faulty operation of the loading device.

These objects are obtained in that an electronic control device is provided which actuates the control members in dependency from electronic switches which react to operating conditions like drive pressure or position, or the like, of the loading device, and that the electronic control device is provided with an arrest circuit which reacts only to the switch pulse of the next following switch in the movement cycle, after receiving the switch pulse of a switch, and leaves pulses of all other remaining switches unaffected or suppresses the same.

In accordance with a preferred embodiment of the invention it is provided that the electronic control device is provided with a bistable memory as the arresting circuit, the set input of which is coupled to one of the switches and the output of which controls, on the one hand, directly or indirectly, the control member which is associated with the switch, and, on the other hand, the return set inputs of the remaining bistable switches, with the exception of the memory which during the movement cycle is associated with the subsequent switch.

The invention provides a simplification of the control in that commonly known mechanical or hydraulic control members, which require a relatively high expense and which cannot be mounted on an arbitrary location, are replaced by a comparatively inexpensive and almost arbitrarily mountable electronic control. Simultaneously, a particularly high safety is achieved against false control of the loading device.

A particularly preferred embodiment of the invention provides a time arrest for shutting off a faulty switching process or for maintaining the predetermined movement cycle, whereby upon determination by the electronic that a faulty switching has occurred for a subsequent movement cycle, the drive of this already initiated movement step is interrupted or changed, after a predetermined time duration, for example, of about 1 second after initiation of the movement step.

The drive of the feeding shovel can be arrested by the electronic control in a simple manner when noticing a switching error. Also a change in the movement step can be carried out, as long as no other danger is created, by a premature switching over to another movement step, for example, following the faulty movement step.

The invention permits a faultless and dangerless course of the initiated movement steps. Furthermore, a facilitated fault determination is made possible in that during the automatic arresting or even at a premature switching over of an already initiated movement step, in particular when the switching or the arresting is done with a time delay, the position of the feeding shovel indicates at which position of the controlling electronic or of the other control elements the error can be found which causes the faulty switching.

Accordingly, all switches which initiate a movement step in accordance with the invention should be tested and checked with respect to their correctness. However, the testing and checking may be limited to individual switching or movement steps, as far as a danger for example a danger source is present in the area of this movement step.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

BRIEF DESCRIPTION OF THE DRAWING

FIG. 9 is a schematic illustration of the movement steps of the feeding shovel in accordance with FIGS. 1 to 8, FIG. 10 is a schematic rear view of an inventive loading device showing the switching connections, FIG. 11 is a schematic illustration of a differently usable electronic control device.

DESCRIPTION OF THE PREFERRED EMBODIMENTS

Figure 1:
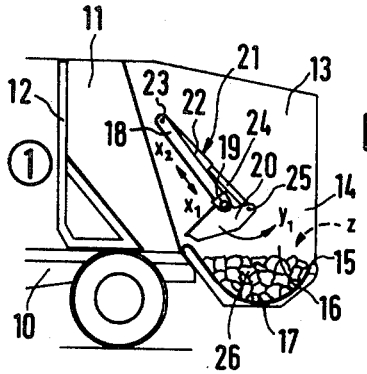
FIGS. 1 to 4 show a loading device with a downward idle stroke of the feeding shovel passing by the loading edge considered as a danger zone at the beginning of one of four movement steps.

FIGS. 1 to 8 show a collecting container 11 mounted on a trash vehicle 10, whereby the collecting container is limited at its front by a plate 12 which can be moved either forwardly or rearwardly for loading or emptying the collecting container. The feeding housing 13 is pivotably mounted on the cover wall which covers the collecting container on the upper side, for example by an upper transverse joint and is fixedly connected with the collecting container 11 or the vehicle chassis during operation, in a suitable manner. The inside of the feeding housing is in open connection with the collection container 11 and is provided on its rear side with a opening 14 having a loading edge 15. This edge simultaneously forms the upper edge of a trough-shaped receiving space 17 limiting the loading chamber 16 downwardly, whereby this space extends to the front to about the height of the lower wall of the collecting container 11 or extends over this wall.

A guide plate 18 is guided in the inside of feeding housing 13 (corresponding to parent patent) in arrow direction $x_1$, $x_2$, for example along the side walls of the feeding housing, and can be driven in arrow direction $x_1$, $x_2$ by cylinder-piston units which are not shown in FIGS. 1 to 8, but which are coupled on their upper ends with the feeding housing and with their lower ends with the guide plate, in accordance for example with the parent patent. A pivotable feeding shovel 20 is mounted on the displaceable guide plate which e.g. may also act as a pressure plate, or the like, by means of a joint 19, whereby the feeding shovel is actuated by a cylinder-piston unit 21 the cylinder 22 of which is mounted on the guide plate 18 by means of a joint 23 and the piston 24 of which is mounted on the feeding shovel 20 by means of a joint 25. The guide plate 18 and the feeding shovel 20 extend over the total width of feeding housing 13 or the loading chamber 16, respectively, while the cylinder-piston unit is provided at each side of the loading chamber for movement thereof.

The mode of operation of the aforementioned loading device is the same as in the parent patent. FIGS. 1 to 8 show the positions of the guide plate 18 and the feeding shovel 20 at the beginning of four sequential moving steps. The individual movement steps of the loading device are shown in the FIGS. 1 to 8 by circled numbers (1) to (4) and are shown for the first embodiment in FIGS. 1 to 4, and in FIGS. 5 to 8 for the second embodiment. In FIG. 9 the movement cycle of the feeding shovel 20 is illustrated, for example, with reference to the lower edge of the shovel with the movement steps $y_1$, $x_1$, $y_2$, $x_2$ and indicated by respective arrows, whereby the switching or the control points at the beginning or at the end, respectively, are designated with A to D. Preferably, the switching at points A and C is path dependent while at points B and D, or in the stroke range preceeding these points is pressure dependent. In furtherance, it is advantageous if at point C the switch is path dependent as well as pressure dependent, whereby under switch it is also to be understood a correction circuit which is to be described in the following.

Figure 5:
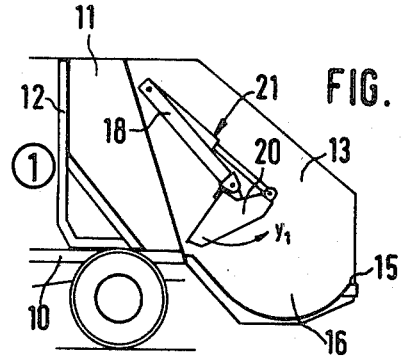
FIGS. 5 to 8 show a loading device with a forward pivot stroke of the feeding shovel passing by the loading edge considered as a danger zone at the beginning of one of the four movement steps.
Figure 6:
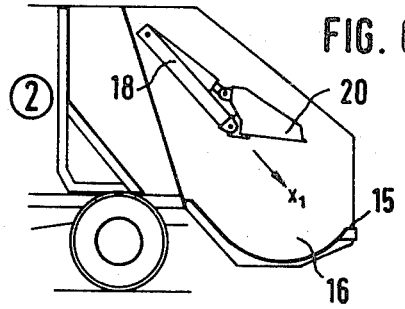
Figure 7:
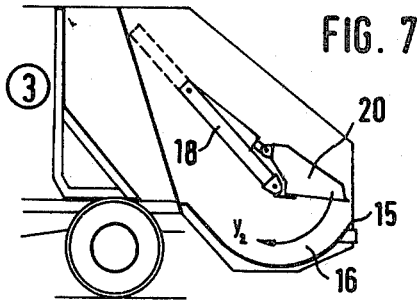
Figure 8:
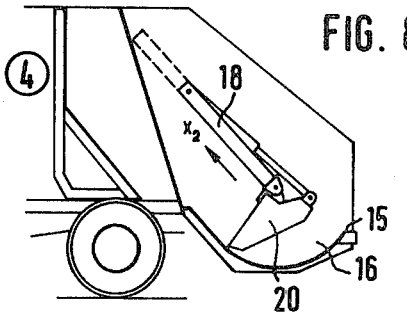

In accordance with FIGS. 1 or 5, respectively, the movement step $y_1$ starts in an upper position of guide plate 18 with a forwardly pivoted feeding shovel 20 (switch point A in FIG. 9). Below feeding shovel 20 and over the edge 15 of feeding housing 13 the bulk goods 26, for example, trash to be fed is charged in arrow direction z (FIG. 1).

Figure 4:
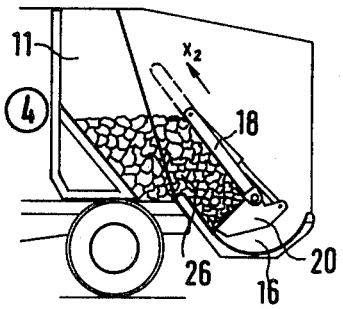

The loading device is switched to its first movement step $y_1$ by an electronic (not shown in detail) which now starts in that the feeding shovel 20 is moved rearwardly in the direction of arrow $y_1$ by means of the cylinder-piston unit 21. This first movement step is finished when in a position according to FIG. 2 or FIG. 6, respectively, (switch point B in FIG. 9). The second movement step $x_1$ follows the first movement step in that the guide plate 18 is moved downwardly in arrow direction $x_1$ and thereby moves along the feeding shovel 20 which remains unchanged at guide plate 18. This downward movement is finished when in a position according to FIGS. 3 or 7, respectively (switch point C in FIG. 9). Thereupon follows the third movement step $y_2$, whereby the guide plate 18 remains in its position, while the feeding shovel 20 is pivoted forwardly around its joint 19 on the guide plate in arrow direction $y_2$ and thereby feeds the bulk goods which is loaded in the receiving space 17 forwardly and partially upwardly in direction of arrow $y_2$. In the fourth movement step $x_2$ which starts in the position as shown in FIG. 4 (switch point D in FIG. 9), the guide plate 18 is moved upwardly in direction of arrow $x_2$ and the bulk goods 26 with the still unchanged pivoted feeding shovel 20 is moved further upwardly and into the collection container with the bulk goods already contained therein until the guide plate 18 and the feeding shovel 20 are again in the initial position of FIG. 1.

These four movement steps may be controlled by end switches or pressure switches (piston pressure switches) in conjunction with the electronic in such a manner that the subsequent movement steps occur only when the preceding movement step is partially finished or is finished, respectively. In order to eliminate dangers, an interruption of the automatic drive may be provided, in accordance with the parent patent, so that it is required to manually switch the next following movement step and to actuate this switch during the total movement cycle.

Figure 2:
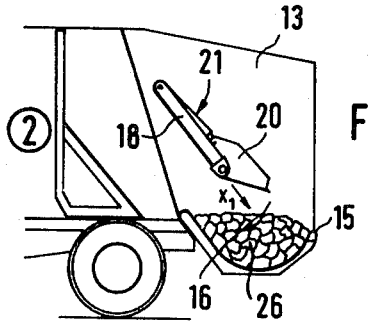
Figure 3:
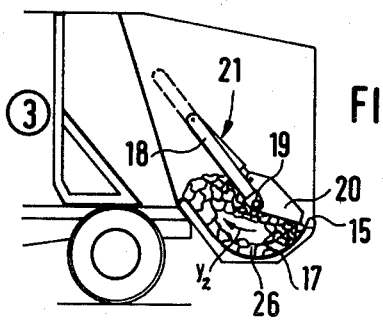

As an example, in the case of the first embodiment the second movement step $x_1$ is preprogrammed as semiautomatic circuit (semiautomatic), so as to eliminate an endangerment of persons on the charge edge 15, however due to an interference in the circuit system it is falsely switched to a permanent pulse instead to a semiautomatic operation in that, for example due to wedged trash the controlled end switch C in the position of FIG. 2 prevents the switching from automatic operation to semiautomatic switching. In this case, the guide plate would start its movement from B to C (FIG. 9) in arrow direction $x_1$ from the position of FIG. 2 into the position of FIG. 3, but would end this movement after a determined time duration.

For this purpose, the electronic is provided with a safety or correction circuit reacting to such a faulty switching which circuit in comparison with the preprogrammed circuit to semi-automatic changes or interrupts the further faulty movement step $x_1$ of the movement cycle in that, for example, the feeding shovel 20, that is, in the embodiment, the drive of guide plate 18 is arrested together with the feeding shovel 20 which is pivoted thereon. For this purpose, a time arrest is preferably provided in the electronic which assures that the faulty initiated movement step is interrupted after a certain time duration, preferably after about one second. In the embodiment in accordance with FIGS. 1 to 4 this correction occurs, for example, in an intermediary position between FIGS. 2 and 3.

If need be, during the interruption of the drive of guide plate 18, the feeding shovel 20 may be prematurely driven in the arrow direction $y_2$, instead of being arrested. Thereby, the position in accordance with FIG. 3 (switch point C in FIG. 9) is not reached and the danger area which would exist before this position or by reaching this position, respectively, is avoided.

In view of the fact that the faulty switched movement step is initiated, but prematurely interrupted, determination of the error source is facilitated.

In the embodiment in accordance with FIGS. 1 to 4 it is the danger area of the movement cycle in the second movement process $x_1$ is assumed to be during the downward movement of the guide plate 18 and of the feeding shovel 20, since the feeding shovel in this movement step is guided by the loading edge 15.

In the embodiment in accordance with FIGS. 5 to 8, a corresponding danger area exists only in the following movement step $y_2$ during the forward pivot movement of the feeding shovel 20 in arrow direction $y_2$, since in this case the preceding (second) movement step $x_1$ is already finished when the feeding shovel 20 still has such a distance from the loading edge, so that an endangerment of the person doing the loading is eliminated, provided that in this embodiment no cover is provided on the feeding device to cover the bulk goods. Therefore, the safety against a faulty switching is in particularly required at or before initiating the third movement step $y_2$, which is consequently the forward pivot movement of the feeding shovel 20 from the position of FIG. 7 into the position of FIG. 8.

A corresponding safety by changing the movement cycle may be provided on one or a plurality of locations of the total cycle of the movement, depending on the situation.

The electronic is advantageously mounted in the proximity of the rear loading device at the side of the feeding housing, so that only short lines are required to the end switches and to the units directly or indirectly driving the feeding shovel, so that the electronic as well as the switches are reasily accessible from the side of the loading device. However, it may be mounted in the driver housing or at any given suitable place. In contrast to a possible control by a relay, the electronic control has the advantage to provide a simple and rapid exchangeability of the program, in addition to a very small space requirement, larger exactness and functional safety.

In particular, the possibility exists to use the same electronic for different voltages within a relatively large volume range, for example, in such a manner that a manageable small box which contains the electronic is provided on both sides with multi-plugs for connecting corresponding counter plugs for feeding and discharge lines. In particular the electronic can be so designed that it is useable for a volt range of about 12 and 24 volt which is the voltage used in trash vehicles.

In FIG. 10 which shows the loading device schematically from the rear, the same components as shown in FIGS. 1 to 8 are provided with the same reference numerals. The reference numeral 18 shows the guide plate which moves in an oblique direction in an upward and downward movement within feeding housing 13, reference numeral 20 designates the pivotable feeding shovel which is pivotably mounted by means of joints 19 on the guide plate and is pivotable relative to the guide plate 18 by means of a cylinder-piston unit 21. The guide plate 18 is driven by a pair of cylinder-piston units 27, having cylinder 28 and piston or piston rod 29, in an upward and downward movement, whereby the cylinder 28 is pivotably mounted by means of a joint 30 on feeding housing 13 and the piston rod 27 by means of a joint 31 on guide plate 18.

In the upper portion of the feeding housing 13 a distribution device 32 for the hydraulic pressure medium is connected, for example, to a front pump which supplies the cylinder 28 and 22 of the cylinder-piston units 27 or 21, respectively. Magnetic valves 33 control the hydraulic pressure medium supplied by the distribution device 32 through lines 34 back to the distribution device, after releasing lines 35, from which the pressure medium is distributed to the cylinders 28 or 22, respectively, by means of lines 36 and 37.

The electronic part of the control encompasses a circuit board 38 (corresponding to the circuit board 29 of the parent patent No. 27 42 401). From this circuit board 38 the control device 39 which contains the electronic is operated, for example, for full automatic, or permanent operation, semi-automatic, or manual switching, which control device depending on the program of the electronic emits control pulses through lines 40 to the magnetic valves 33, which in return control the individual movement steps of the feeding shovel 20 through the distribution device 32 and either directly through cylinder-piston units 21 or indirectly through the guide plate 18 which is driven by the cylinder-piston unit 27.

Path depending control signal transmitters are mounted on feeding housing 13 for the course of the movement steps in form of end abutments **41*a*, 41*b* and are actuated, for example, by an abutment 42 which is mounted on the guide plate 18 in such a manner that the end switch 41*a* is actuated at the end of the downward stroke and the end switch 41*b* on the end of the upward stroke of the guide plate 18. The end switches 41*a* and 41*b* are, for example, provided with known yielding elements 41*c* which yield when being engaged by abutment 42** and thereby close or open the required contact.

The lines **41*d* connect the end switches 41*a* and 41*b* with the electronic in control device 39 which in the preprogrammed sequence releases the magnetic valves 33 and thereby the individual movement steps. In addition to the transmitters the actuated end abutments 41*a*, 41*b*, pressure dependent control signal transmitters, for example, in form of piston pressure switches are provided, for example, on the distribution device 32 and are mounted in the hydraulic system on the distribution device 32, as shown in the exemplified manner in FIG. 10 by reference numeral 43. They affect, in particular that during a pressure increase in the cylinders 22 or 28 above a permissible value, in particular in the end position of pistons 24*a* or 29*a*, respectively, a signal is transmitted to the electronic in the control device 39, so that the preprogrammed switching from one movement step to the next is caused. If a faulty switching occurs, for example, in that one of the end switches 41*a* or 41*b* control signal transmitters are jammed by a bulky piece of trash and therefore switches to permanent operation, the electronic in the control device 39 acts to interrupt the drive of the feeding shovel 20 or the guide plate 18**, respectively, or causes the drive to be switched in any other manner by a corresponding preprogrammed correction pulses.

Preferably, the control device 39 with the electronic contained therein is so designed that it can be coupled to current systems having different voltages, for example, in a voltage range between a onefold and a twofold value. If need be, elements may be contained in the electronic which measures the input voltage or the input current, respectively and regulate the same to a constant capacity.

The control devices may also be designed for different programs, so that different programs may be transmitted by a simple selective mounting of corresponding connection elements. As an example, in FIG. 11 it is indicated that the control device 39 is provided with plug-in bores 44 into which plug pins 45*a* or 45*b* of plug elements 46*a* or 46*b*, respectively, may be inserted, thus transmitting the different programs. In FIG. 10 such plug elements are indicated at 46.

Figure 12:
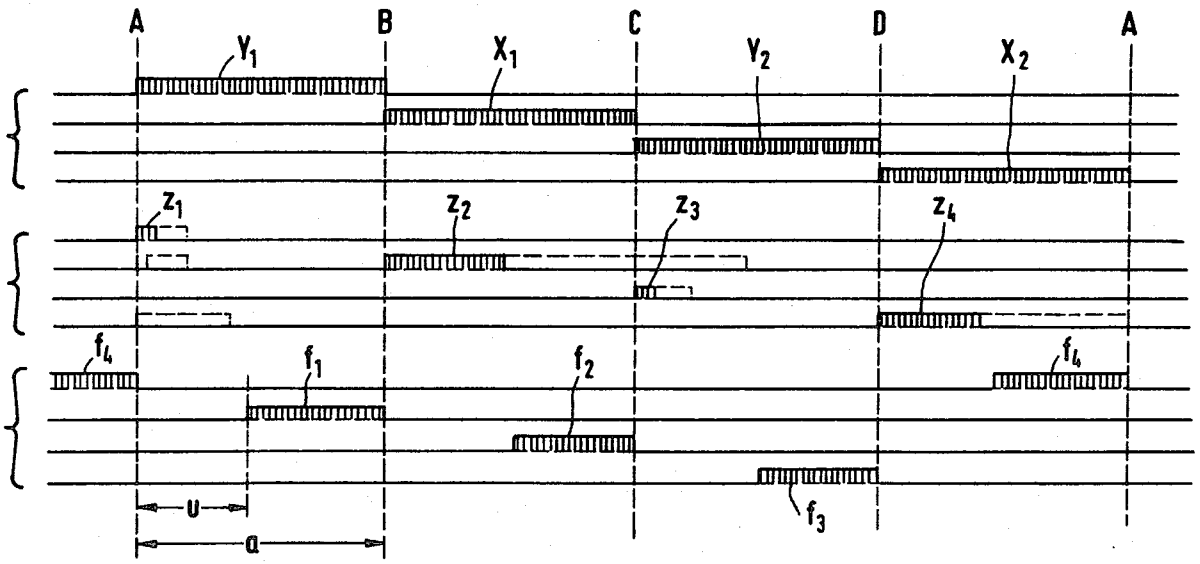
FIG. 12 is a diagram illustrating arrestable movement steps.

As can be seen from FIG. 12 the individual strokes $y_1$, $x_1$, $y_2$, $x_2$ are shown schematically in their cyclic operation together with the control switching points A, B, C, D, corresponding to FIG. 9. The execution of the individual movement step is shown by shaded lines.

FIG. 12 further illustrates exemplified possibilities of switching fault sources which are created by pressure peaks during the switching due to the required acceleration of the mass, so that faulty switches may be triggered. They can extend over different time durations $z_1$, $z_2$, $z_3$, $z_4$.

In accordance with the invention a correction circuit is provided which prevent such faulty switches. For this purpose, the switch order from the control signal transmitters 38, 39, 43, etc., transmitted to a switch point A, B, C or D is arrested by the electronic.

FIG. 12 also shows when a switch order is transmitted at the initiation of each movement step and when it is released for the subsequent movement step. This is carried out by an electronic time arrest after a determined time duration u which, for example, amounts to a fraction of a total movement step a. The release times $f_1$, $f_2$, $f_3$, $f_4$ are so chosen that the time durations $z_1$, $z_2$, $z_3$, $z_4$ are completed before the release takes place (that is $u > z_1$ etc.).

In order to achieve the time arrest, the pulse triggered by the corresponding control device is released by the electronic through a condensor or another given electrical time member, for example, a counter, only after termination of the arresting time, for example, one second, which corresponds to the pulse insensitive stroke. After the faulty pulse, for example, which was triggered in the switching point A by pressure peaks during the sudden switching, is fading after a more or less long time interval $z_1$, the release of the switch pulse for initiating the movement step $x_1$ following the movement process $y_1$ may occur after the work cycle of stroke u, since the feeding shovel can execute its further stroke in the hydraulic system without influenced by pressure peaks until point B is reached, whereby a new pressure increase occurs due to the stroke limitation which now results in the switching to stroke $x_1$.

If need be, particular safety elements, for example, varistors or free wheel diodes may be provided through which damaging pressure peaks may be eliminated, in particular upon switching from a preceding to a subsequent movement step.

Advantageously, the timely arresting is not only performed in conjunction with a pressure dependent switch, but is provided in each case. This facilitates a diagnosis of eventual mistakes in the drive or in the control, respectively, since the feeding shovel executes a certain but limited stroke after switching to the faulty movement step, so that it can be clearly established at which point an error can be found.

Figure 13:
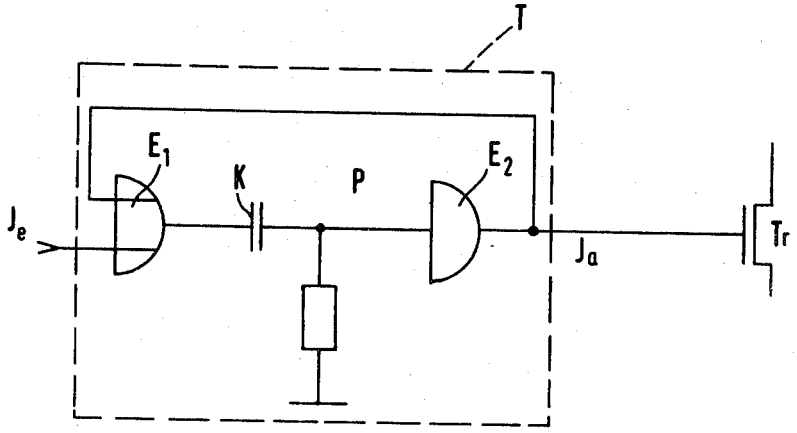
FIGS. 13 and 14 are two switching circuits illustrated for time arrests.

FIG. 13 shows as an example in which manner a timely delay is obtainable, in particular for time arresting. Thereby, the input pulses $J_e$ are fed to a condensor K through a switching circuit $E_1$ executing an OR-connection, whereby the condensor is discharged through a resistor R with a predetermined time constant. A separator stage $E_2$, for example, a comparator, the output of which is back coupled with an input of switching system $E_1$ emits an output signal only as long as a voltage above the threshold voltage is present on switching point P which voltage during the discharge operation of the condensor K will not be attained, after a certain time duration, for example, 1 second. Thereby, the separator stage $E_2$ generates an output signal for the duration of one second which, as an example, can be fed to the gate electrode of a transistor $T_r$. If it is, as shown, a field effect transistor which in the normal condition is permeable, the transistor will be arrested by the output signal of separator stage $E_2$ for the duration of the output signal.

Figure 14:
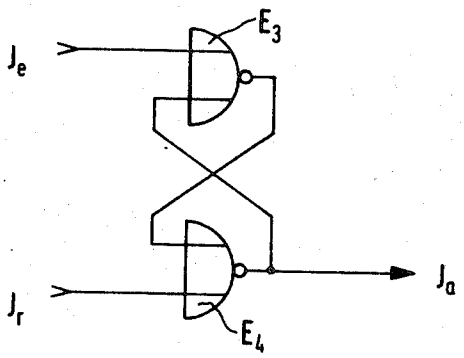

In furtherance, FIG. 14 shows a diagram for storing the input pulses. A bistable switch, or a flip-flop is shown which after input of its set input signal $J_e$ emits at its one output a signal $J_a$ until a reset signal $J_r$ is emitted to the return set input. Thereby, the flip-flop, in a known manner, is placed into one state by the set signal $J_e$ and into the other state by the return set signal $J_r$. Thereby, the one state is characterized by the emission of an output signal $J_a$, in the other state no output signal is emitted. If set signal $J_e$ and return set signal $J_3$ are simultaneously present, also no output signal $J_a$ is emitted.

As shown in FIG. 14 the flip-flop may be realized in the shown manner by two negative OR-gates (NOR-gates).

Figure 15:
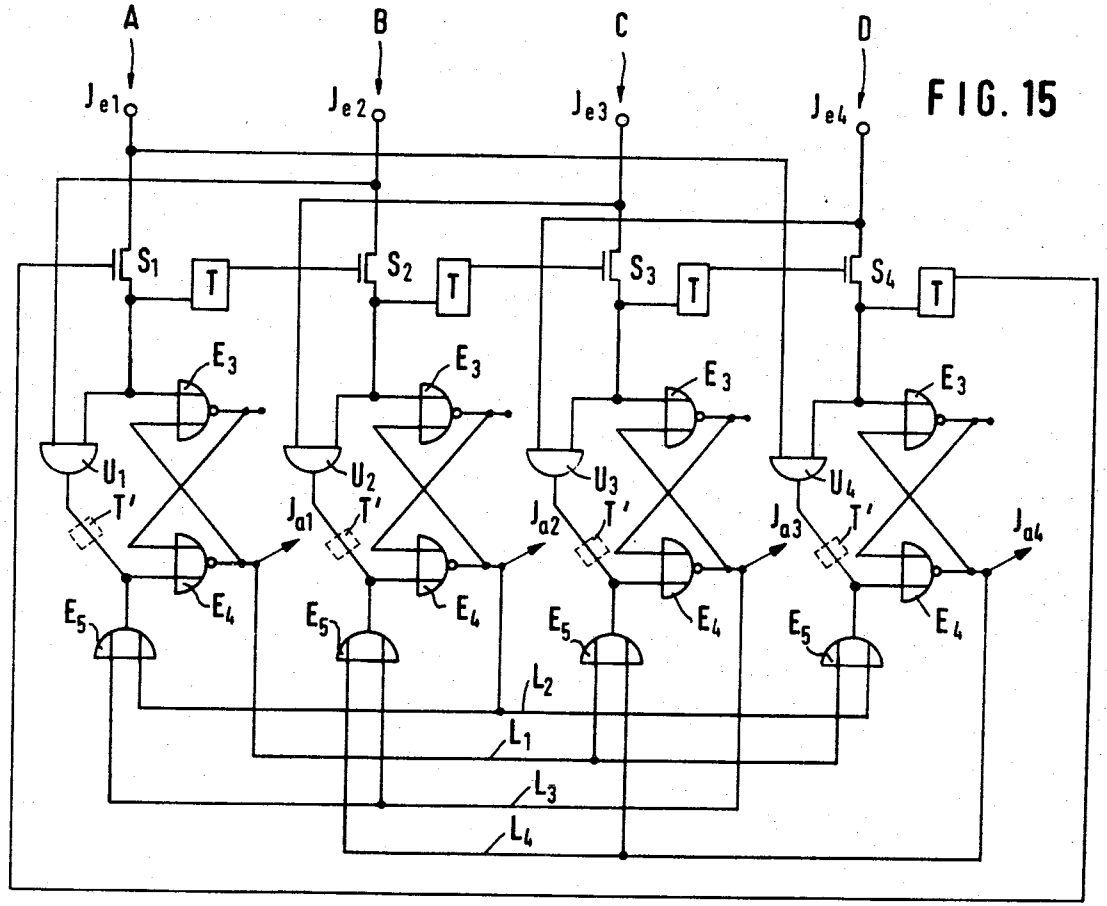
FIG. 15 is a schematic switching plan for guaranteeing the correct course of the movement steps.

In furtherance, FIG. 15 shows a diagram for forcing a preprogrammed cycle of sequential movement steps with eliminating of faulty switchings due to orders, which otherwise would trigger a movement step not being present in the cycle.

$J_{e1}$, $J_{e2}$, $J_{e3}$, $J_{e4}$ are the order signals emitted from the control devices or the switches on the switch points A, B, C and D. First of all, it is to be assumed that switches $S_1$ to $S_4$ are closed. Thereby, the control signals are fed to the set input of a flip-flop formed by the NOR-elements $E_3$ or $E_4$, respectively, so that an output signal $J_{a1}$ to $J_{a4}$ is emitted. The control signal $J_{e1}$ which is emitted from the control signal transmitter or the switch point A, respectively, generates the output signal $J_{a1}$ on the associated flip-flop which switches the control member through not shown amplification for providing the movement step $y_1$, see FIG. 9, of the loading device. When the loading device reaches its position at the switching point B, the corresponding transmitter or switch is excited for generating the control signal $J_{e2}$, which places the subsequently switched flip-flop into a state in which the control members are put into operation by means of the output signal $J_{a2}$ which affect the movement steps $x_1$, see FIG. 9, etc.

Each of the output signals $J_{a1}$ to $J_{a4}$ are also returned to the return set inputs of the flip-flops associated with the other switch points by means of the OR-gates $E_5$, with the exception of the flip-flop which is associated with the directly following switch point. As an example, the output signal $J_{a1}$ of the flip-flop associated with switch point A is only fed to the return inputs of the flip-flop associated with switch point C and D, however not to the return input of the flip-flop associated with switch point B. Thereby, it is achieved that after actuating of the transmitter or of the switch on switch point A of the circuit shown in FIG. 15 only one control signal $J_{e2}$ can be considered which is emitted from the switch or the transmitter at the switch point B. The signals of the remaining switches or transmitters remain without consideration, that is the switches or the transmitters, are electronically arrested at the switch points C and D. In the circuit shown in FIG. 15 it is achieved that the output signals $J_{a1}$ to $J_{a4}$ which trigger the movement steps $y_1$, $x_1$, $y_2$, $x_2$, see FIG. 9 can be generated only in the correct sequence corresponding to the determined movement cycle.

The switches $S_1$ to $S_4$ are normally closed, that is, the signals $J_{e1}$ to $J_{e4}$ pass through. By means of delay circuits T these switches may be opened for a determined time period, for example, one second. These delay switches T generate an output signal with a limited time duration (for example, one second) to open the switches $S_1$ to $S_4$ when one of the control signals $J_{e1}$ to $J_{e4}$ is present. Consequently, a control signal $J_{e2}$ which e.g. is emitted from the switch or transmitter at switch point B can be considered by the electronic control shown in FIG. 15 only after a determined time duration (for example, one second), after the generation of control signal $J_{e1}$ by the switch or the transmitter at switching point A. The same is true for the other switching points. This measure constitutes an electronic time arrest, with the result that, again compare FIG. 9, the movement step $x_1$ can be initiated only after a certain time duration after the start of movement step $y_1$, the movement step $y_2$ only after a certain time period after the start of movement step $x_1$, the movement step $x_2$ only after a certain time period after the start of the movement step $y_2$, and the movement step $y_1$ only after a certain time duration after the start of the movement step $x_2$.

Field effect transistors (like Tr in FIG. 13), which in the normal condition are conductive may be used as switches $S_1$ to $S_4$. The time delay circuits T in FIG. 15 may have the same structure as shown in FIG. 13.

Sequential control signals $J_{e1}$ to $J_{e4}$, in the movement cycle are fed in pairs to the inputs of AND-gates $U_1$ to $U_4$, whereby the order signals $J_{e1}$ and $J_{e2}$ are fed to the AND-gate $U_4$, the control signals $J_{e2}$ and $J_{e3}$ to the AND-gate $U_2$, the control signals $J_{e3}$ and $J_{e4}$ to the AND-gate $U_3$ and the control signals $J_{e4}$ and $J_{e1}$ to the AND-gate $U_4$. These AND-gates generate an output signal only when the associated control signals are present at the same time. The output signals of the AND-gates are fed to the return set signals of the flip-flops $E_3/E_4$, so that the respective flip-flops can be set back and cannot generate an output signal $J_{a1}$ to $J_{a4}$. Thereby, it is achieved that for example the output signal $J_{a1}$ which initiates the movement step $y_1$ in FIG. 9 can be only generated when the control signal $J_{e1}$ is generated on switch point A without simultaneously generating the order signal $J_{e2}$ on switch point B.

The same holds true for the remaining output signals $J_{a2}$ to $J_{a4}$.

Due to the design the following mode of operation is obtained:

It is to be assumed that the switch or control signal transmitter has delivered its control signal $J_{e2}$ on the switch point B (thereby the output signal $J_{a2}$ is generated which initiates the movement step $x_1$ in FIG. 9) and then remains in the excited state, that is, the control signal $J_{e2}$ is permanently generated. The loading device moves in a normal manner through movement steps $x_1$, $y_2$ and $x_2$. However, the movement step $y_1$ cannot be initiated any longer, because the correctly generated control signal $J_{e1}$ on switch point A cannot lead in this case, to the output signal $J_{a1}$ which triggers the movement step $y_1$. The AND-gate $U_1$ receives together with the control signal $J_{e1}$ the permanently generated control signal $J_{e2}$, so that the AND-gate generates an output signal which retains the flip-flop $E_3/E_4$ associated with switch point A in a set back position, whereby an output signal $J_{a1}$ cannot be emitted.

Thereby, the loading device remains in the end position associated with switch point A. Therefore, the operating personnel can immediately recognize that the switch or the control signal transmitter emits a faulty permanent signal on switch point A, for example, due to jamming of trash or contamination.

The same holds true for the remaining switch points. Therefore the described arrangement permits an immediate recognition of the cause of the failure.

The invention is not limited to the described embodiments, but can be used for other movement cycles wherein similar problems occur, as described. In accordance with the invention, movement cycles with more or less than four movement steps may be controlled and, if need be, with only one movement step in a movement cycle.

The circuits shown in FIGS. 13 to 15 may be realized with commercially available components or groups of components, preferably in C-MOS technique.

The switch shown in FIG. 15 may be advantageously varied by further time delay circuits T' which are provided on the output line of the AND-gates $U_1$ to $U_4$ and have the same structure as the time delay circuit T in FIG. 13. Thereby, an eventual generated output signal of the AND-gates $U_1$ to $U_4$ is delayed, for example, for one second and is further emitted to the return set inputs of the flip-flops $E_3/E_4$. This results in the following movement operation:

The loading device may correctly actuate the associated switch control signal transmitter on switch point A, while simultaneously the switch emits a faulty permanent signal at the switch point B. In this case, the control signal $J_{e1}$ can generate the control signal $J_{a1}$, however, the latter is switched off after one second, since due to the subsequent switched time delay circuit T' the delayed output signal of the AND-gate $U_1$ (this output signal is generated, since $J_{e1}$ and $J_{e2}$ are simultaneously present) sets back the flip-flop $E_3/E_4$ associated to the switch point A. Thereby, the loading device can move past the switch point A for the time duration of one second and then is arrested in accordance with the movement phase $y_1$ in FIG. 9.

Advantageously, this interference can be easily differentiated from the case, that no signal $J_{e2}$ can be generated on the switch point B due to a defect on the switch or the control signal transmitter, because in the latter case, the loading device would be arrested in the end position corresponding to switch point B.

The same holds true for the remaining switch points.

It will be understood that each of the elements described above, or two or more together, may also find a useful application in other types of constructions differing from the types described above.

While the invention has been illustrated and described as embodied in a control device for a loading device for bulk goods containers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Control arrangement for a loading device for bulk goods containers, in particular trash vehicle collecting containers with a loading chamber receiving the bulk goods and a motor driven feeding shovel which executes a movement cycle, for feeding the bulk goods from the loading chamber into the bulk goods container, which is separated into sequential movement phases which are initiated during the course of the movement cycle which actuates control members, characterized in that an electronic control device (39) is provided which actuates the control members (33) in dependency from electronic switches (41*a, b;* 43) which react to operating conditions of the loading device, and that the electronic control device (39) is provided with an arrest circuit (FIG. 15) which reacts only to the switch pulse of the next following switch in the movement cycle, after receiving the switch pulse ($J_{e1}'$ $J_{e2}$, $J_{e3}$, $J_{e4}$) of a switch (41*a, b;* 43), and leaves all other remaining switches unaffected so that in the event that one of the remaining switches emits an incorrect switch pulse or signal the arrest circuit assures that the feeding shovel cannot execute an inadmissible movement cycle.

2. Control arrangement in accordance with claim 1, characterized in that the electronic control device (39) is provided with a bistable memory (FIG. 14) as the arresting circuit, the set input of which is coupled to one of said switches (41*a,b;*43) and the output ($J_{a1}$,$J_{a2}$,$J_{a3}$,-$J_{a4}$) of which controls the control member (33) associated with the switch and the return set inputs of the remaining bistable switches which during the movement cycle is associated with the subsequent switch (FIG. 15).

3. Control arrangement in accordance with claim 2, characterized in that the outputs of two sequentially actuated switches are coupled to the inputs of an AND-gate during the movement cycle of the loading device, the output of the AND-gate being coupled with the reset input of the bistable memory associated with the first of the two switches.

4. Control arrangement in accordance with claim 1, characterized in that a time arrest is provided which at a false switching of one of the electronic switches for a subsequent movement step determined by the electronic control device interrupts or changes the drive in this already initiated movement step, after a predetermined time duration, for example, of about 1 second after the initiated movement step.

5. Control arrangement in accordance with claim 1, characterized in that the drive of the feeding shovel (20) is arrested when a false switching of one of the electronic switches has been established by the electronic control device.

6. Control arrangement in accordance with claim 1, characterized in that when the electronic control device establishes a false switching of one of the electronic switches, a premature switching to a movement step is executed which follows the movement step falsely initiated by the electronic switch having falsely switched.

7. Control arrangement in accordance with claim 1, characterized in that electronic means are provided, in particular means for measuring the input current and controlling the power input, in such a manner that the electronic control device is useable for a larger voltage range, at least between the onefold and twofold of a rated voltage.

8. Control arrangement for a loading device on bulk goods container with an electronically controlled feeding shovel in accordance with claim 1, characterized in that the electronic control device is provided with such a number of connections, in particular plug-in elements that it is usable for different types of applications for differently arranged control members and electronic switches by using a given different limited number of the connections.

9. Control arrangement in accordance with claim 1, characterized in that safety elements are provided through which harmful voltage peaks are eliminated, in particular upon switching from a preceeding to a subsequent movement step.

10. Control arrangement in accordance with claim 1, wherein the feeding shovel executes a plurality of movement steps, in particular a forward pivot stroke with the bulk goods which is received over a loading edge of the loading chamber, an upward feeding stroke to the bulk goods collecting container, a return pivot stroke at which the bulk goods is delivered to the bulk goods collecting container, and a downward idle stroke in the area of the loading edge, characterized in that each movement step is initiated by one of the electronic switches and that at least the output of the electronic switch initiating a subsequent movement step of the cycle passing a danger area is subjected to a safety device.

11. Control arrangement in accordance with claim 10, characterized in that the downward idle stroke (arrow direction $X_1$) and the upward feeding stroke (arrow direction $X_2$) are pressure dependent controlled and the upward pivot stroke (arrow direction $Y_2$) and the return pivot stroke (arrow direction $Y_1$) are path dependent controlled.

12. Control arrangement in accordance with claim 11, characterized in that the forward pivot stroke is additionally pressure dependent controlled.

13. Control arrangement in accordance with claim 10, characterized in that all outputs of the electronic switches are subjected to a safety device.

14. Control arrangement in accordance with claim 10, characterized in that, upon selective switching to continuous operation (automatic) and to a semiautomatic operation with sequentially switchable movement steps, the safety device becomes effective when a faulty permanent pulse is transmitted by one of the electronic switches at a preprogrammed semiautomatic operation.

15. Control arrangement in accordance with claim 1, characterized in that the electronic control device (39) actuates the control members (33) in dependency from electronic switches (41*a, b;* 43) which react to drive pressure of the loading device.

16. Control arrangement in accordance with claim 1, characterized in that the electronic control device (39)

actuates the control members (33) in dependency from electronic switches (41*a, b;* 43) which react to position of the loading device.

17. Control arrangement in accordance with claim 1, characterized in that the electronic control device (39) actuates the control members (33) in dependancy from the electronic switches (41*a, b;* 43) which react partially to drive pressure and partially to position of the loading device.

18. Control arrangement in accordance with claim 1, characterized in that electronic interruption devices ($S_1$ to $S_4$) are provided in the output lines of the switches (41*a, b;* 43) wherein each interruption device is switched with a predetermined time lag to its conducting state in which switch pulses of the associated switch are transmitted to the electronic control device, after the switch which in the cycle preceeds the associated switch, has generated its switch pulses.

* * * * *